US010569406B2

(12) United States Patent
Aoki

(10) Patent No.: US 10,569,406 B2
(45) Date of Patent: Feb. 25, 2020

(54) WORK TOOL

(71) Applicant: MAKITA CORPORATION, Anjo-shi, Aichi (JP)

(72) Inventor: Yonosuke Aoki, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 429 days.

(21) Appl. No.: 15/435,400

(22) Filed: Feb. 17, 2017

(65) Prior Publication Data

US 2017/0239803 A1 Aug. 24, 2017

(30) Foreign Application Priority Data

Feb. 19, 2016 (JP) ..... 2016-030373

(51) Int. Cl.
*B25F 5/00* (2006.01)
*B25F 5/02* (2006.01)

(52) U.S. Cl.
CPC ..... *B25F 5/006* (2013.01); *B25F 5/008* (2013.01); *B25F 5/02* (2013.01)

(58) Field of Classification Search
CPC .. B25F 5/006; B25F 5/02; B25F 5/008; B25F 5/029; B25F 5/00
USPC ..... 173/162.2, 110; 451/354, 357, 359, 451
See application file for complete search history.

(56) References Cited

U.S. PATENT DOCUMENTS 4,463,544 A * 8/1984 Carsello ..... A01G 3/062 172/13
4,749,049 A * 6/1988 Greppmair ..... F16F 15/08 173/162.2
6,286,610 B1 * 9/2001 Berger ..... B25D 17/24 173/162.1
6,996,960 B1 * 2/2006 Flemm ..... A01D 34/416 30/276
7,921,935 B2 * 4/2011 Engelfried ..... B25D 17/043 173/162.2
7,967,079 B2 * 6/2011 Stierle ..... B25F 5/006 173/162.2
2003/0015066 A1 * 1/2003 Chao ..... B25B 21/00 81/57.26
2005/0061524 A1 * 3/2005 Hagan ..... B23B 45/001 173/217
2005/0153637 A1 * 7/2005 Janson ..... B24B 23/005 451/359
2006/0096770 A1 * 5/2006 Roberts ..... B25F 5/02 173/217
2006/0113098 A1 * 6/2006 Inagawa ..... B24B 23/028 173/162.2
2006/0254897 A1 * 11/2006 Hamisch ..... B25F 5/02 200/401

(Continued)

*Primary Examiner* — Robert F Long
(74) *Attorney, Agent, or Firm* — Oliff PLC

(57) ABSTRACT

It is an object of the invention to provide an ergonomically excellent work tool while maintaining high manufacturing efficiency. A representative work tool is provided which performs a prescribed operation on a workpiece by driving a tool accessory. The work tool has an inner housing that houses a motor and a spindle, an outer housing and an elastic member. A first inner housing element and a second inner housing element are assembled while being opposed to each other in a transverse direction, and a first outer housing element and a second outer housing element are assembled while being opposed to each other in a vertical direction.

7 Claims, 15 Drawing Sheets

(56) References Cited

U.S. PATENT DOCUMENTS

2007/0044984 A1* 3/2007 Fischer ..... B25D 17/043 173/217
2007/0056757 A1* 3/2007 Stirm ..... B25D 17/043 173/162.2
2007/0295521 A1* 12/2007 Wiker ..... B24B 23/028 173/162.1
2008/0153401 A1* 6/2008 Wuensch ..... B25F 5/006 451/344
2010/0068977 A1* 3/2010 Zhang ..... B24B 23/02 451/357
2010/0095533 A1* 4/2010 Takahashi ..... A01G 3/053 30/228
2010/0206596 A1* 8/2010 Kamegai ..... B23D 51/01 173/162.2
2011/0120740 A1* 5/2011 Moreno ..... B25D 17/043 173/162.2
2012/0031639 A1* 2/2012 Roberts ..... B25D 17/043 173/162.2
2012/0111595 A1* 5/2012 Schadow ..... B25F 5/006 173/162.2
2012/0118599 A1* 5/2012 Schadow ..... B25F 5/006 173/162.2
2012/0125648 A1* 5/2012 Schadow ..... B25F 5/006 173/46
2012/0160533 A1* 6/2012 Kamegai ..... B25D 17/24 173/162.2
2013/0025897 A1* 1/2013 Harcar ..... B25D 17/043 173/162.2
2013/0199811 A1* 8/2013 Maddilate ..... B25F 5/02 173/170
2014/0208575 A1* 7/2014 Jagdale ..... E02F 3/966 29/525.02
2014/0352994 A1* 12/2014 Yoshikane ..... B25D 17/04 173/162.2
2015/0034347 A1* 2/2015 Hess ..... B25F 5/006 173/162.2
2015/0144367 A1* 5/2015 Fruh ..... B25F 5/006 173/162.2
2015/0152901 A1* 6/2015 Stieler ..... B25F 5/02 411/367
2015/0202764 A1* 7/2015 Roberts ..... B25D 17/24 173/162.2
2017/0087706 A1* 3/2017 Moore ..... B25D 17/06
2018/0029215 A1* 2/2018 Zhong ..... B25F 5/006
2019/0009398 A1* 1/2019 Zhong ..... B25F 3/00

* cited by examiner

WORK TOOL

TECHNICAL FIELD

The present invention relates to a work tool which performs a prescribed operation on a workpiece by driving a tool accessory.

BACKGROUND ART

U.S. Unexamined Patent Application Publication No. 2015/034347 discloses a hand-held work tool which transmits an output of a driving motor to a spindle to drive a tool accessory. This work tool has a housing that houses the driving motor and the spindle. A user performs a prescribed operation while holding the housing and pressing the tool accessory against a workpiece.

SUMMARY OF THE INVENTION

Problem to be Solved by the Invention

In the above-described work tool, the housing that houses mechanism members such as the motor and the spindle is formed by connecting a first housing element and a second housing element. For this purpose, the first and second housing elements are configured to be assembled while being opposed to each other in a direction (transverse direction of the work tool) crossing a direction of a rotation axis of the spindle (vertical direction) and a longitudinal direction of the housing (longitudinal direction). With this structure, the mechanism members are mounted in one of the housing elements in advance before assembling the housing elements. In this case, the assembling direction is set to the transverse direction of the work tool, so that the operations of mounting the mechanism members and assembling the housing elements can be relatively easily performed.

When the first and second housing elements are assembled, however, a joint between the first and second housing elements is formed at least on an upper surface of the housing. The upper surface is held as a handle part by a user, so that the joint comes in contact with a user's palm and may give discomfort to the user.

Accordingly, it is an object of the present invention to provide an ergonomically excellent work tool while maintaining high manufacturing efficiency.

Representative Embodiment for Solving the Problem

The above-described problem is solved by the present invention described in claims. According to the present invention, in order to perform a prescribed operation on a workpiece by driving a tool accessory, a work tool is provided which has a motor, a spindle having a rotation axis and configured to be rotated on the rotation axis within a prescribed angular range via the motor to drive the tool accessory, an inner housing configured to house at least the motor, an outer housing having an elongate form and configured to house the inner housing, and an elastic member disposed between the inner housing and the outer housing.

The inner housing has a first inner housing element and a second inner housing element which are assembled into the inner housing. The first inner housing element and the second inner housing element may be symmetrically or asymmetrically formed. Further, assembling the first and second housing elements suitably includes the manner of forming the inner housing in its entirety and the manner of forming the inner housing in part. The inner housing houses at least the motor, but more typically, the inner housing is preferably configured to house the spindle in addition to the motor. Further, the manner of "housing the motor" includes the manner of housing the motor in its entirety in the inner housing and the manner of housing the motor in part in the inner housing.

The outer housing has a first outer housing element and a second outer housing element which are assembled into the outer housing. The first outer housing element and the second outer housing element may be symmetrically or asymmetrically formed. Further, assembling the first and second housing elements suitably includes the manner of forming the outer housing in its entirety and the manner of forming the outer housing in part. The outer housing typically houses the inner housing in its entirety, but it may be configured to house the inner housing only in part.

Here, a longitudinal direction of the elongate outer housing is defined as a longitudinal direction, an extending direction of the rotation axis of the spindle is defined as a vertical direction, and a direction perpendicular to the longitudinal direction and the vertical direction is defined as a transverse direction. The first inner housing element and the second inner housing element according to this invention are assembled while being opposed to each other in the transverse direction. At this time, preferably, the motor (and the spindle) is mounted in one of the first outer housing element and the second outer housing element to form a sub-assembly in advance, and thereafter the sub-assembly and the other inner housing element are assembled while being opposed to each other in the transverse direction to form the inner housing. In order to mount the motor and further typically the spindle in the one inner housing element, in the case of a typical structure in which the axes of the motor and the spindle typically extend in the vertical direction, the motor (and the spindle) is mounted in the one inner housing element from the transverse direction in the absence of the other inner housing element in the transverse direction, and thereafter, the two inner housing elements are assembled together in the transverse direction. Thus, the mechanism parts can be easily mounted in the inner housing.

The state that the first and second inner housing elements are "opposed to each other in the transverse direction" refers to the state that the inner housing elements are arranged side by side in the transverse direction and connected to each other in the transverse direction. Typically, it is defined as the state that joint surfaces of the first and second inner housing elements are connected to each other with their normals extending in the transverse direction.

Further, the first outer housing element and the second outer housing element are assembled while being opposed to each other in the vertical direction. The state that the first and second outer housing elements are "opposed to each other in the vertical direction" refers to the state that the outer housing elements are arranged side by side in the vertical direction and connected to each other in the vertical direction. Typically, it is defined as the state that joint surfaces of the first and second outer housing elements are connected to each other with their normals extending in the vertical direction.

The outer housing typically has a handle part to be held by a user. In this invention, the elastic member is disposed between the inner housing and the outer housing, so that vibration which is caused in the inner housing prone to become a vibration source during operation is effectively prevented from being transmitted to the outer housing. In this manner, vibration countermeasures are effectively taken for a user who holds the outer housing.

Further, in forming the outer housing, the first outer housing element and the second outer housing element are assembled while being opposed to each other in the vertical direction. This assembling typically results in that the joint formed by connecting the outer housing elements is present on the right and left sides (and the front and back sides) of the outer housing. In actual use of the work tool, typically, the user's palm is placed on the upper side of the outer housing when the user holds the outer housing as a grip. In this invention, the joint between the outer housing elements is not present in the vicinity of the user's palm. Therefore, such a problem of giving discomfort to a user which may otherwise be caused by contact of the joint with the user's palm is prevented. Specifically, "the outer housing has a handle part at least on an upper side in the vertical direction and a joint between the first and second outer housing elements which is configured (which is formed on the left and right sides and the front and back sides) to be avoided from being formed in the handle part)".

In the work tool according to the present invention, the spindle is configured to be rotated on the rotation axis of the spindle within a prescribed angular range. It may be configured such that the "prescribed angle" is fixed to a constant angle or varied by prescribed operation. Further, typically, it is preferably configured such that the rotation period of the spindle within a prescribed angular range is constant, but it may also be configured such that the rotation period is varied by prescribed operation.

Further, the tool accessory may widely include tools capable of performing operation by being driven by the spindle rotating on the rotation axis within a prescribed angular range. The operation to be performed includes a cutting operation, a scraping operation and a grinding operation. The tool accessory may be freely replaced according to the operation. The tool accessory is freely selected from various kinds of tool accessories according to the operation and mounted to the single work tool. Therefore, the work tool may also be referred to as a "multi tool".

Further, a clamp shaft may be used to mount the tool accessory to the spindle. Typically, the tool accessory is arranged and held between the clamp shaft and the spindle. In this case, the spindle has a hollow shape extending along the rotation axis and the clamp shaft is inserted through the hollow part. The clamp shaft is configured to be movable in the direction of the rotation axis with respect to the spindle so as to be switched between a tool accessory holding position and a tool accessory releasing position. The clamp shaft holds the tool accessory in the tool accessory holding position during operation, and for replacement of the tool accessory, the clamp shaft is placed in the tool accessory releasing position.

A lock mechanism for the clamp shaft may be preferably provided in order for the clamp shaft to hold and release the tool accessory. The lock mechanism is preferably configured to be movable between an engaging position for locking the clamp shaft in the tool accessory holding position and a disengaging position for unlocking the clamp shaft and allowing the tool accessory to be released. With this structure, the tool accessory is easily held and released through user's manual operation of the lock mechanism.

According to one aspect of the present invention, the work tool may have a brushless motor as the motor, and a controller that controls driving of the brushless motor. In this case, an output shaft of the brushless motor may be arranged in parallel to the rotation axis of the spindle. By this parallel arrangement, a power transmitting mechanism for transmitting a rotation output of the brushless motor to the spindle may be arranged closer to the tool accessory than in a prior art structure. As a result, the couple balance of the power tool during operation is improved so that vibration is further reduced.

According to one aspect of the present invention, the work tool may have a fastening member configured to fasten the first and second outer housing elements to each other. The fastening member may be configured to extend in a direction of the rotation axis, and the outer housing may be configured to have a housing space for the fastening member between a stator of the brushless motor and the spindle.

With this structure, when assembled together, the outer housing elements are reliably fastened to each other via the fastening member, and members necessary for this fastening are rationally housed in the outer housing.

According to one aspect of the present invention, the fastening member housing space may be configured to also serve as an elastic member housing space for housing the elastic member. With this structure, utilization efficiency of the space within the work tool is further improved.

According to one aspect of the present invention, the work tool may further have an electrical member. Further, the inner housing may have an elongate form extending in the longitudinal direction of the outer housing. The inner housing may house at least the motor (and more preferably the spindle) in one end region in the longitudinal direction and have the electrical member in the other end region. The electrical member widely includes electrical equipment and components in the work tool, such as a controller (a unit substrate on which a CPU for driving the motor and a switching element are integrally mounted) for controlling driving of the motor and an electric switch. With this structure, relatively heavy parts such as the motor and the electrical member are arranged in a distributed manner within the end regions of the elongate inner housing. By this arrangement, the moment of inertia of the inner housing is increased, so that vibration caused in the inner housing during operation is reduced.

According to one aspect of the present invention, the work tool may further have a battery mounting part for mounting a battery for driving the motor. In this case, the inner housing may have an elongate form extending in the longitudinal direction of the outer housing. The inner housing may house the motor (and the spindle) in one end region in the longitudinal direction and have the battery mounting part in the other end region. By this arrangement, the relatively heavy battery can be mounted to the end region on the side opposite to motor, so that the heavy parts are arranged in a distributed manner over the inner housing. Thus, the moment of inertia of the inner housing is increased, so that vibration caused in the inner housing during operation is minimized.

According to one aspect of the present invention, the work tool may have an intervening member, and the elastic member may be held in the transverse direction between the inner housing and the outer housing via the intervening member. In this invention, as described above, the outer housing is designed from an ergonomic viewpoint to be configured such that the first and second outer housing elements are assembled while being opposed to each other in the vertical direction. Even with such a vertically assembled structure of the outer housing, the elastic member is held in the transverse direction between the inner housing and the outer housing via the intervening member. Therefore, ease of assembling the outer housing and the inner housing with the intervening member disposed therebetween is improved. The intervening member may be typically formed in the outer housing to protrude to the inner housing side and to be held in contact with the elastic member.

As described above, according to the present invention and various aspects of the invention, an ergonomically excellent work tool is provided while maintaining high manufacturing efficiency.

EMBODIMENTS FOR CARRYING OUT THE INVENTION

Figure 1:
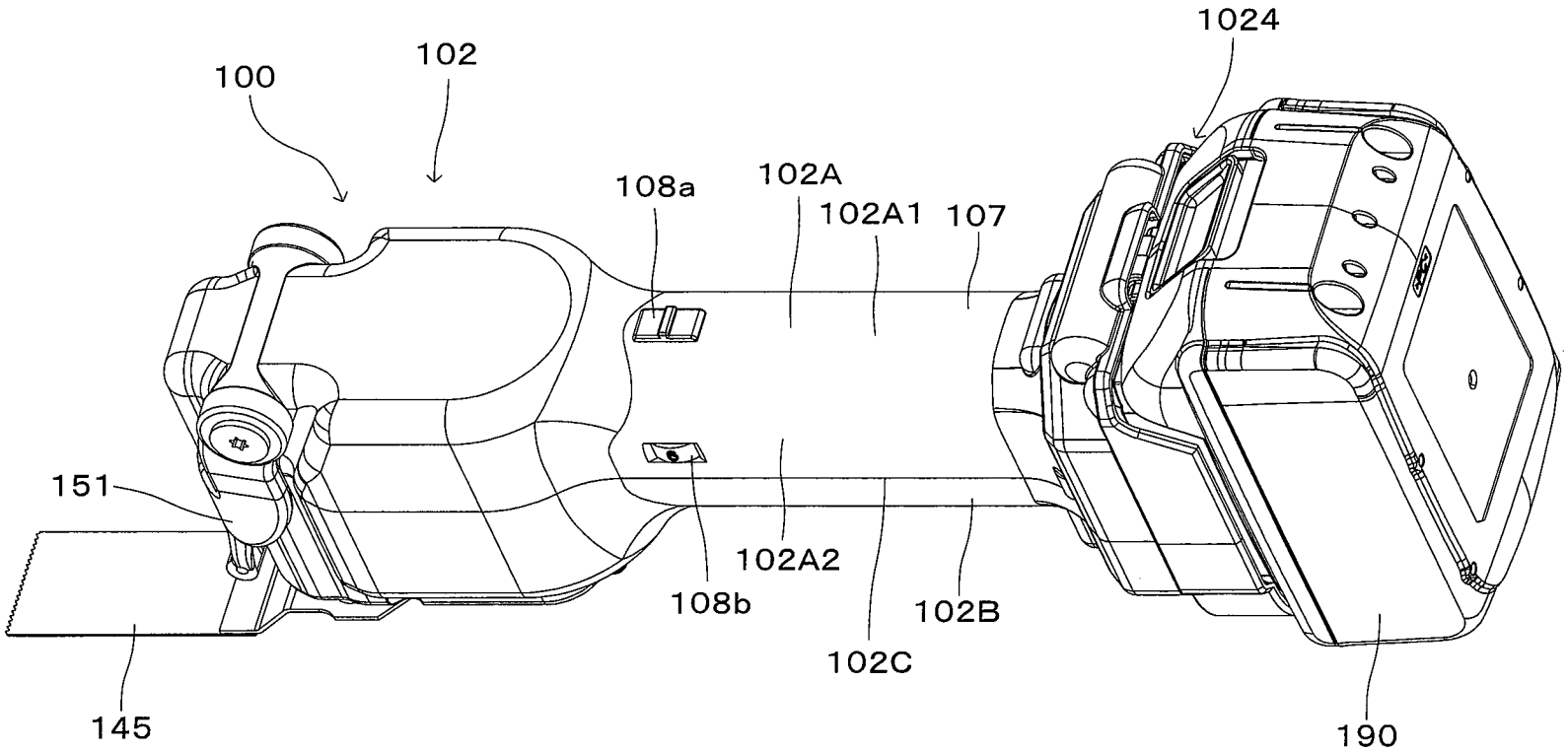
FIG. 1 is a perspective view showing an oscillating tool according to an embodiment of the present invention.

A representative embodiment of a work tool according to the present invention is now described with reference to FIGS. 1 to 15. As shown in FIG. 1, an electric oscillating tool 100 is described as a representative example of the work tool according to the present invention. The oscillating tool 100 is capable of selectively using plural kinds of tool accessories such as a blade and a polishing pad and performing an operation such as a cutting operation and a polishing operation corresponding to the kind of the selected tool accessory on a workpiece by oscillating the tool accessory attached to the oscillating tool 100. In FIG. 1, a blade 145 is attached as a representative example of the tool accessory. The blade 145 is an example embodiment that corresponds to the "tool accessory" according to the present invention.

(Outer Housing)

Figure 2:
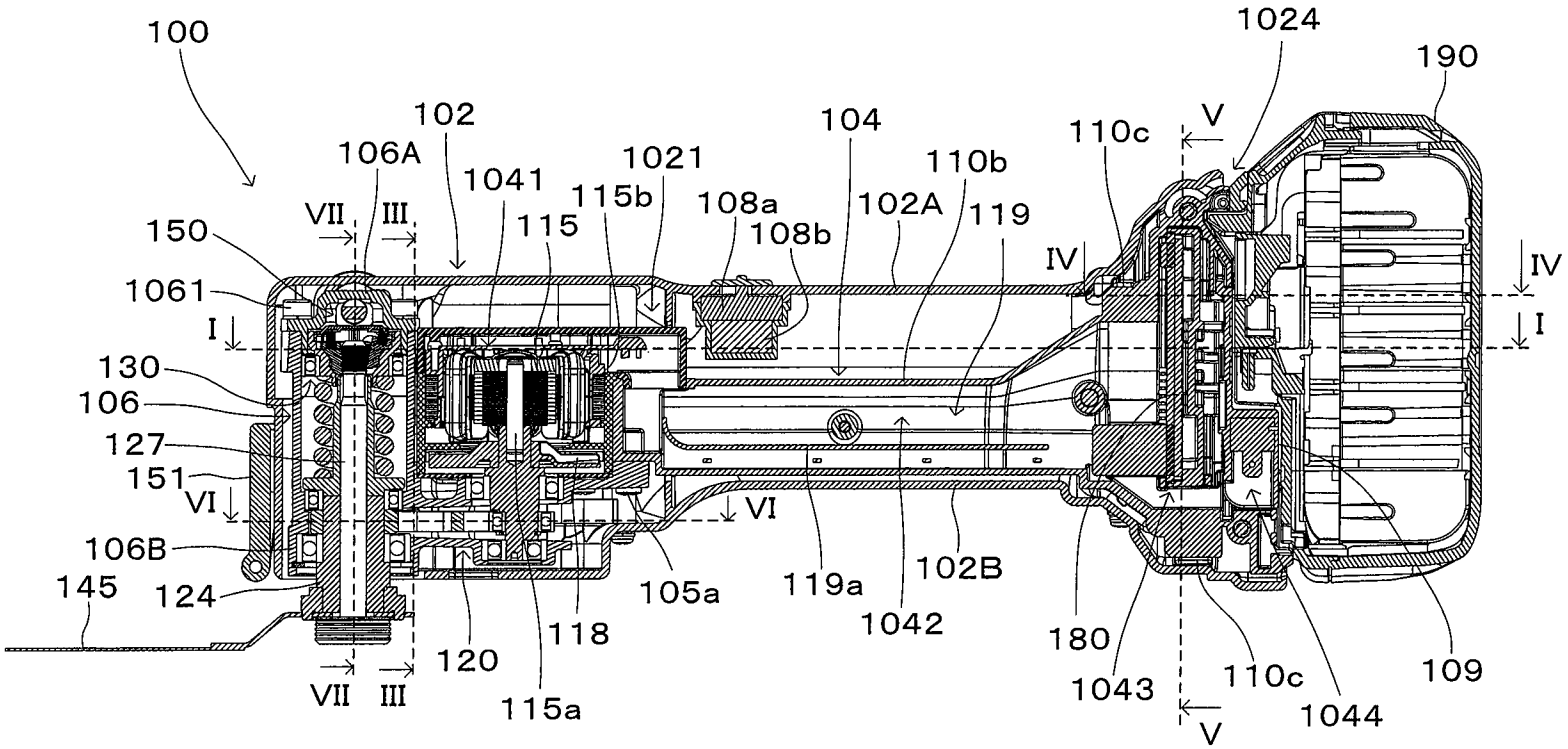
FIG. 2 is a longitudinal section view of the oscillating tool.
Figure 3:
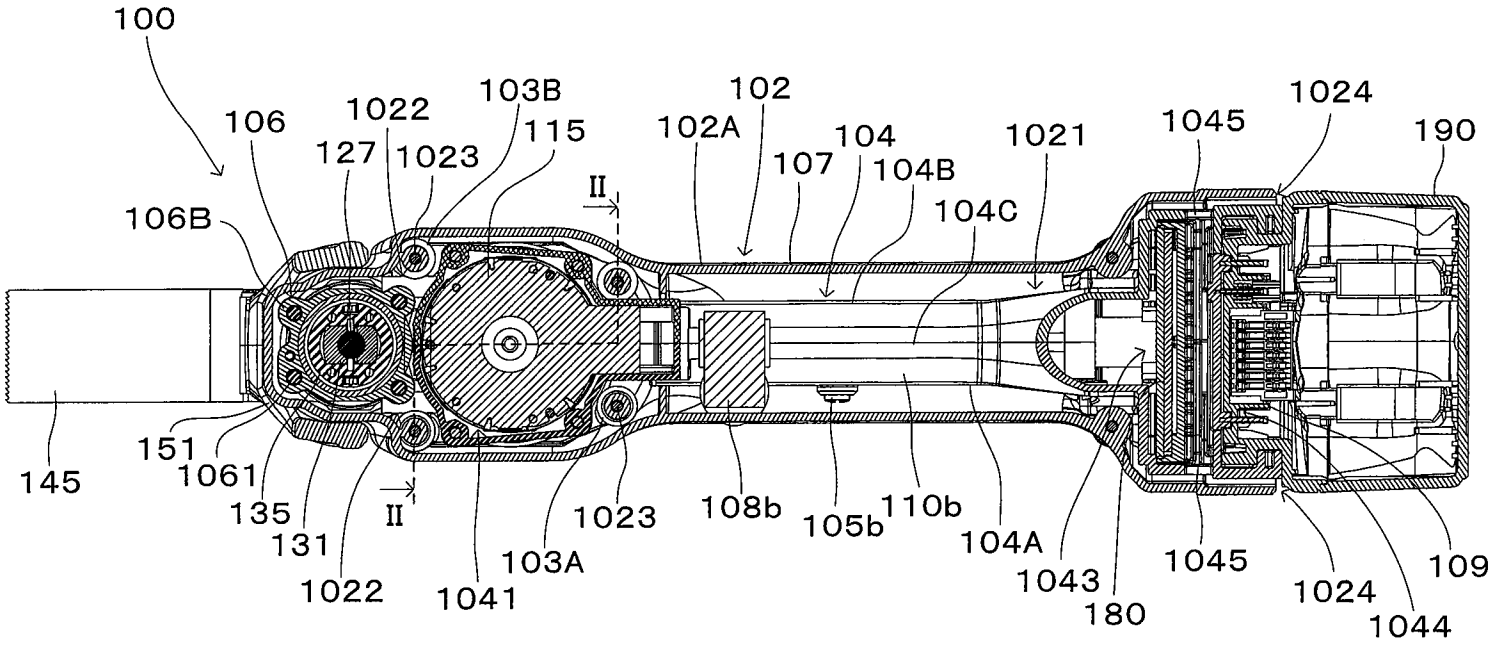
FIG. 3 is a cross section view of the oscillating tool.

The oscillating tool 100 has an outer housing 102 which forms an outer shell of the oscillating tool 100 as shown in FIG. 1. The outer housing 102 is formed of synthetic resin and, as shown in FIGS. 2 and 3, the outer housing 102 forms a housing space 1021 which houses a driving mechanism housing 106 and an inner housing 104. FIG. 3 is a sectional view taken along line I-I in FIG. 2. The outer housing 102 and the inner housing 104 are example embodiments that correspond to the "outer housing" and the "inner housing", respectively, according to the present invention.

As shown in FIG. 2, the outer housing 102 has an elongate form extending in a direction crossing an extending direction of a rotation axis of a spindle 124. In this embodiment, the longitudinally extending direction of the outer housing 102 is defined as a longitudinal direction (horizontal direction as viewed in FIG. 2), and in the longitudinal direction, one side (left side as viewed in FIG. 2) on which the blade 145 is attached and the other side (right side as viewed in FIG. 2) are respectively defined as a front side and a rear side of the oscillating tool 100. The extending direction of the rotation axis of the spindle 124 described below is defined as a vertical direction, and in the vertical direction, one side (upper side as viewed in FIG. 2) on which a lock operation mechanism 150 described below is mounted and the other side (lower side as viewed in FIG. 2) on which the blade 145 is mounted are respectively defined as an upper side and a lower side of the oscillating tool 100. Further, a direction (direction of a normal to a paper plane of FIG. 2) crossing both the longitudinal direction and the vertical direction is defined as a transverse direction of the oscillating tool 100. The transverse direction corresponds to a vertical direction in FIG. 3 and to a horizontal direction in FIG. 9 which is a sectional view taken along line in FIG. 3. Further, in the transverse direction, the lower side as viewed in FIG. 3 (right side as viewed in FIG. 9) and the upper side as viewed in FIG. 3 (left side as viewed in FIG. 9) are respectively defined as a right side and a left side of the oscillating tool 100. These definitions of the directions are also appropriately applied in the following descriptions relating to the other drawings and structures.

Figure 4:
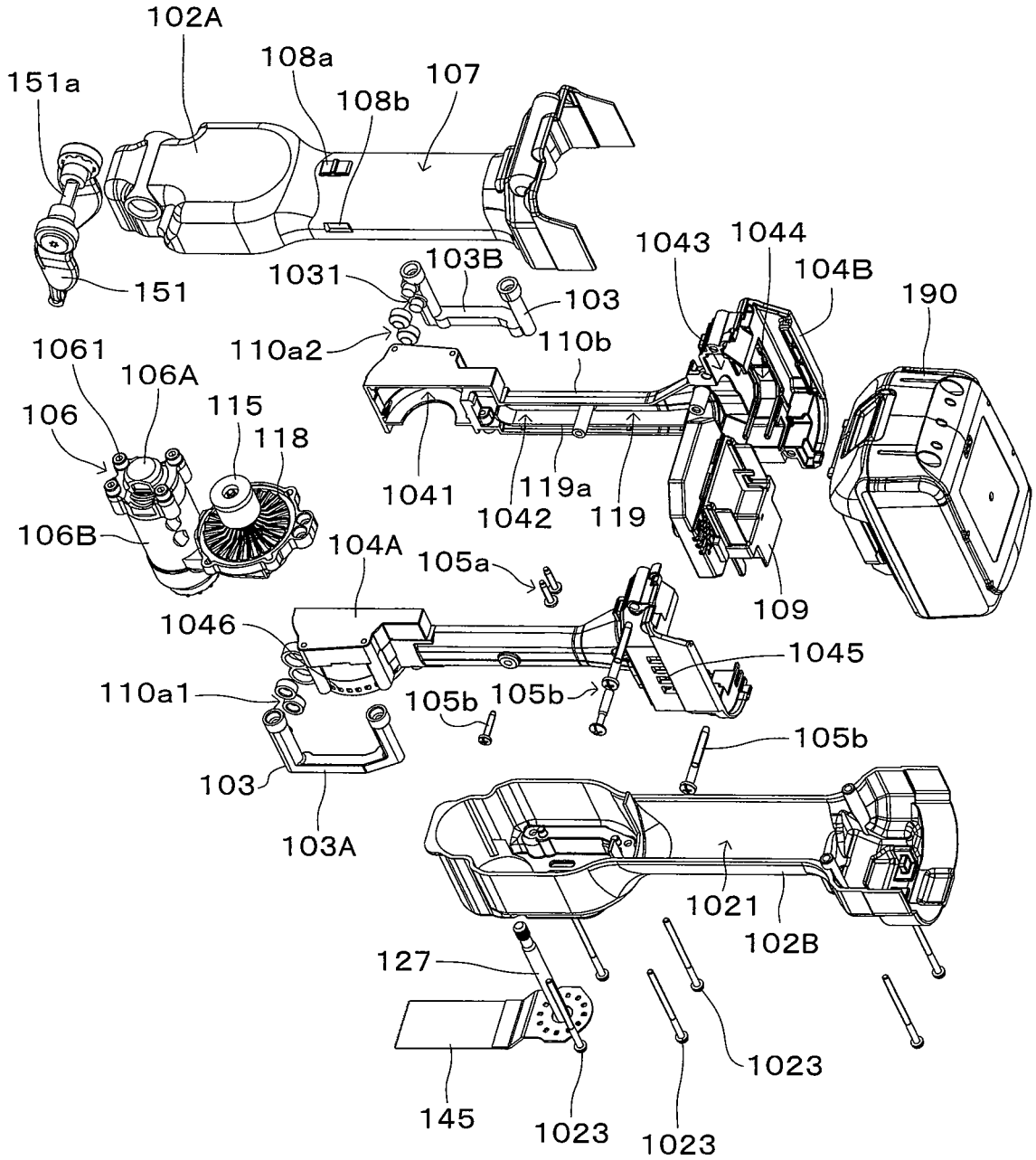
FIG. 4 is an exploded, perspective view showing parts of the oscillating tool.
Figure 5:
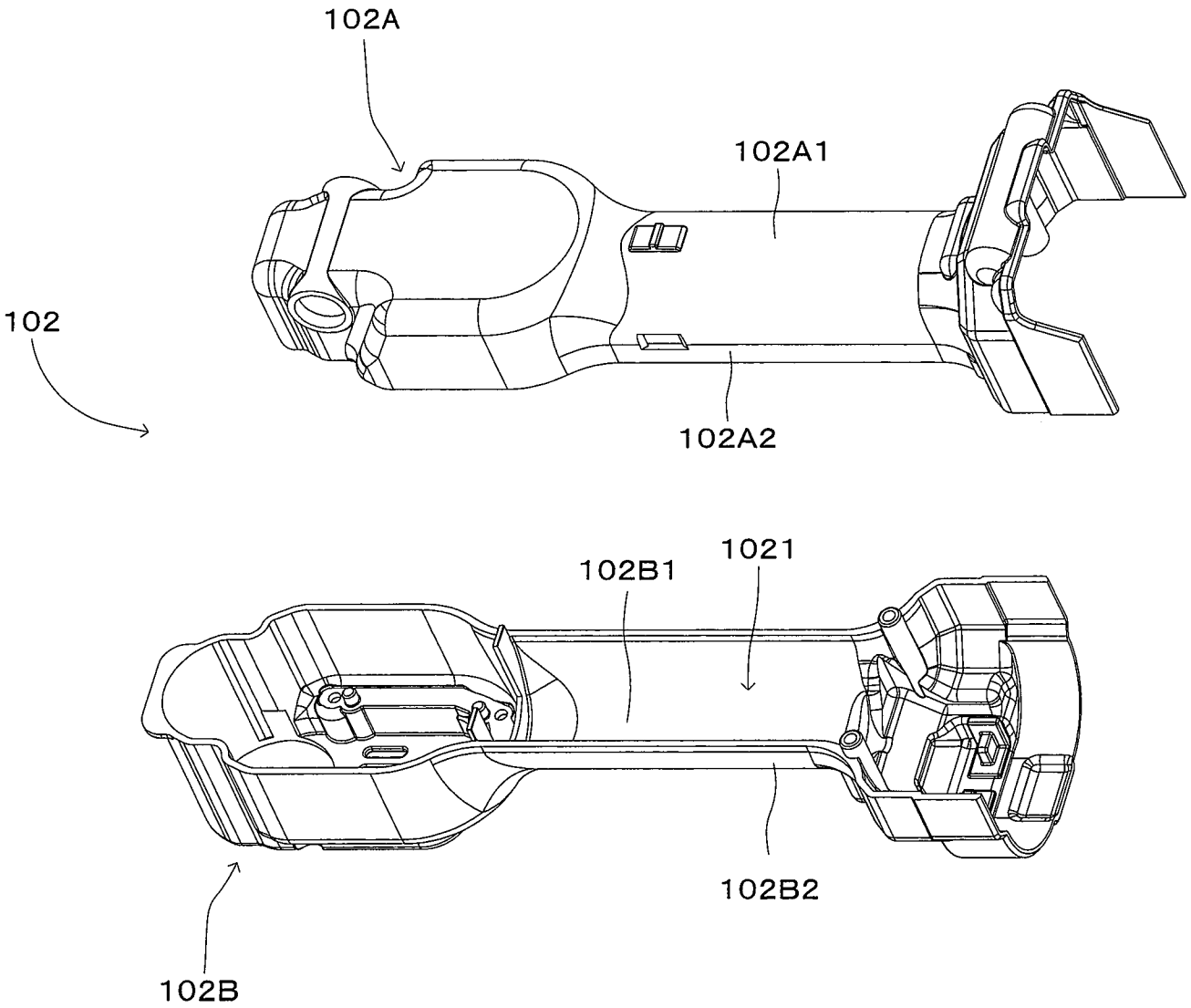
FIG. 5 is an exploded, perspective view showing parts of an outer housing.

As shown in FIGS. 4 and 5, in order to form the outer housing 102, an upper outer housing element 102A and a lower outer housing element 102B are butted and connected (assembled while being opposed to each other) in the vertical direction. The upper outer housing element 102A and the lower outer housing element 102B are example embodiments that correspond to the "first outer housing element" and the "second outer housing element", respectively, according to the present invention.

As shown in FIG. 5, the upper outer housing element 102A has an upper wall 102A1 and a side wall 102A2 extending downward from the upper wall 102A1. The side wall 102A2 is formed on the front, right and left sides of the upper outer housing element 102A. Specifically, the upper outer housing element 102A has an open rear side. The lower outer housing element 102B has a lower wall 102B1 and a side wall 102B2 extending upward from the lower wall 102B1. The side wall 102B2 is formed on the front, right and left sides of the lower outer housing element 102B. Specifically, the lower outer housing element 102B has an open rear side.

Figure 7:
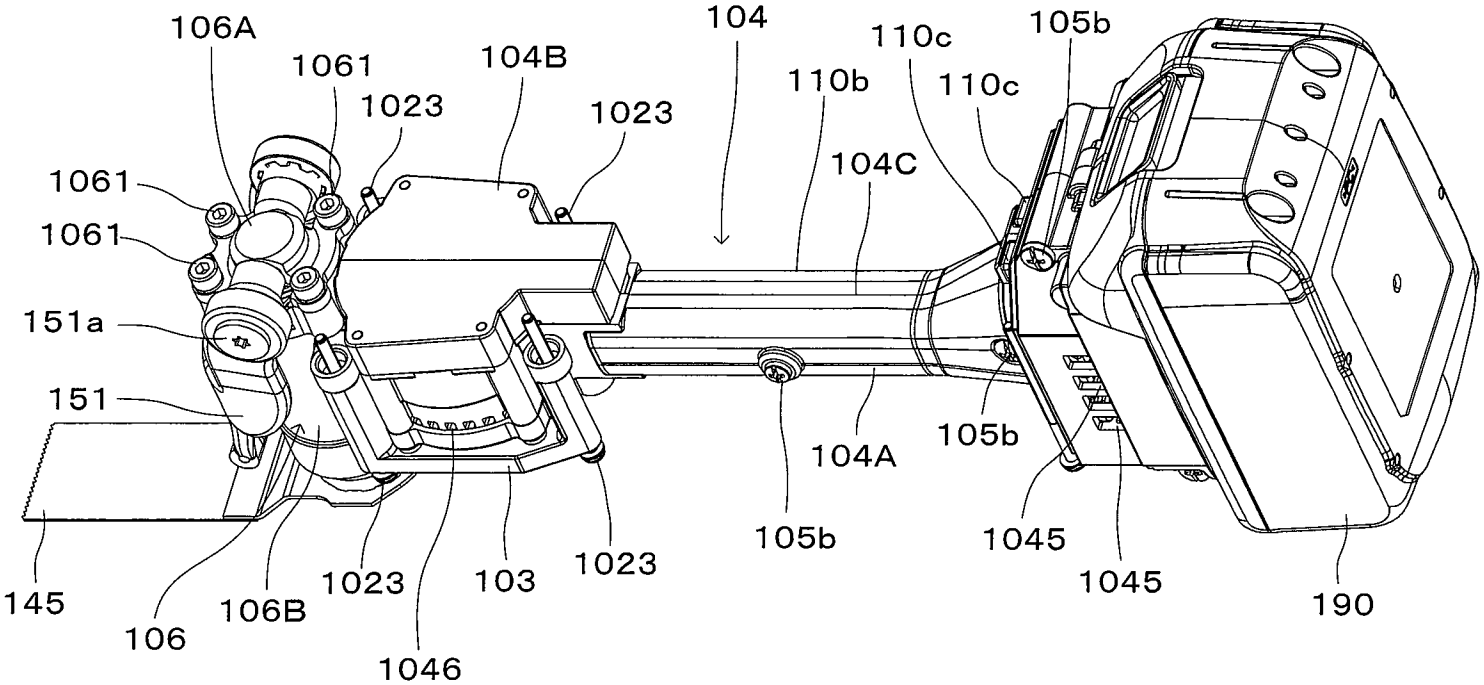
FIG. 7 is a perspective view showing the structures of the inner housing and an intervening member.
Figure 8:
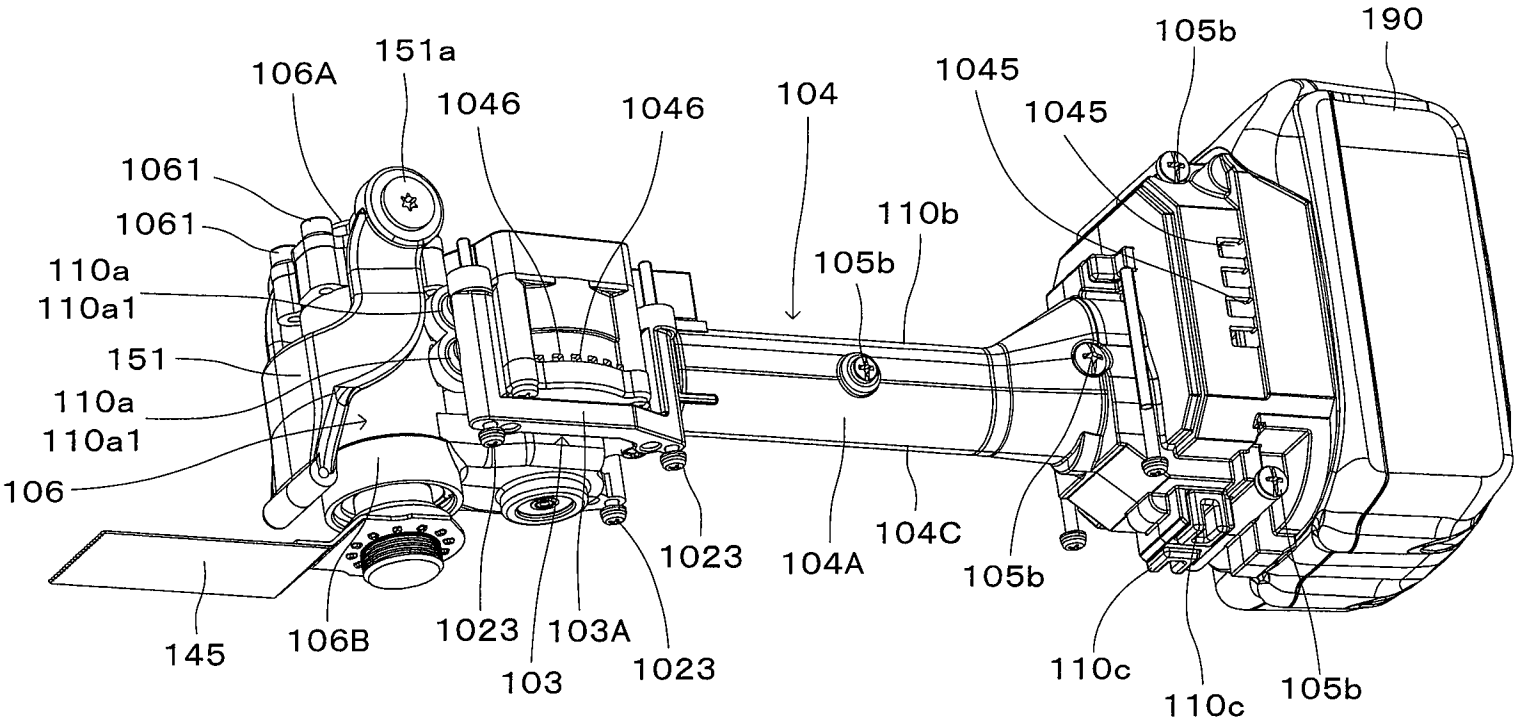
FIG. 8 is a sectional view showing the structure of the inner housing and the intervening member.
Figure 9:
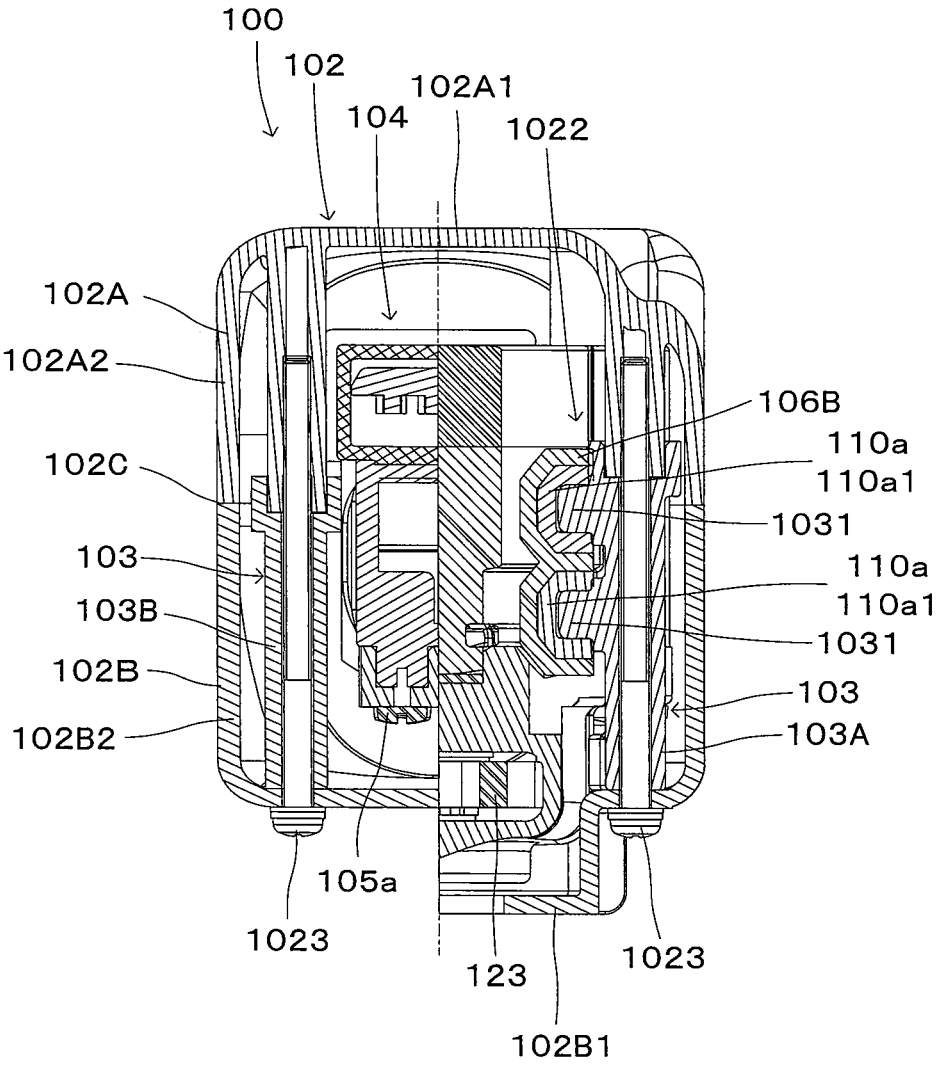
FIG. 9 is a sectional view showing the structures of the outer housing and the intervening member.
Figure 10:
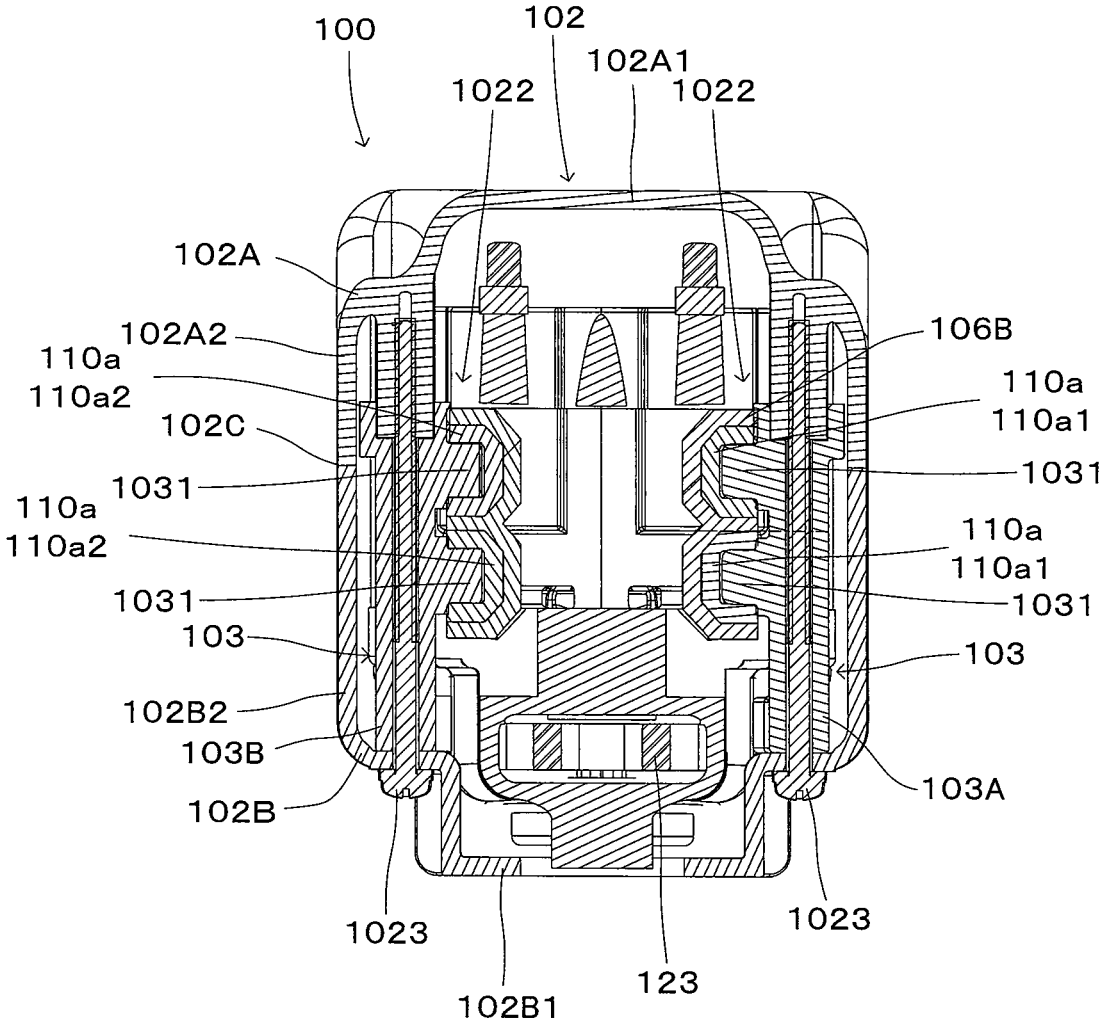
FIG. 10 is a sectional view showing the structure of a front elastic member.

The upper outer housing element 102A and the lower outer housing element 102B are integrally connected via an intervening member 103 shown in FIGS. 4, 7 and 8. The intervening member 103 is an example embodiment that corresponds to the "intervening member" according to the present invention. More specifically, as shown in FIGS. 9 and 10, the upper outer housing element 102A, the lower outer housing element 102B and the intervening member 103 disposed between the upper and lower outer housing elements 102A, 102B are integrally connected by fastening members 1023. At this time, as shown in FIGS. 4 and 5, the upper and lower outer housing elements 102A, 102B are assembled while being opposed to each other in the vertical direction. As a result, as shown in FIGS. 9 and 10, an outer housing joint 102C is formed by assembling the upper and lower outer housing elements 102A, 102B and extends in a longitudinal direction of the outer housing 102 (a direction of a normal to a paper plane in FIGS. 9 and 10). The outer housing joint 102C is configured to be avoided from being formed in the upper wall 102A1 of the upper outer housing element 102A. The outer housing joint 102C is not present in the upper wall 102A1 which typically comes in contact with a palm of a user when the user holds the outer housing as a handle part. Therefore, an ergonomically excellent structure is provided which does not give discomfort to the user who holds the outer housing.

Further, the intervening member 103 is formed of synthetic resin and includes a right intervening element 103A and a left intervening element 103B. The fastening members 1023 are screws. FIG. 9 is a sectional view taken along line II-II in FIG. 3, and FIG. 10 is a sectional view taken along line III-III in FIG. 2.

With this structure, the outer housing 102 forms the housing space 1021 surrounded by the upper wall 102A1, the side wall 102A2, the lower wall 102B1 and the side wall 102B2. Further, the outer housing joint 102C (see FIG. 1) is formed at the abutment between the side walls 102A2 and 102B2. As described above, the outer housing joint 102C extends in the longitudinal direction while being avoided from being formed in the upper wall 102A1.

As shown in FIGS. 1 and 3, an intermediate region of the outer housing 102 in the longitudinal direction has a thin part 107 having a smaller width than front and rear regions of the outer housing 102 in the transverse direction. In the oscillating tool 100, as described below, a brushless motor 115 is housed in the front region, and a controller 180 and a battery mounting part 109 are housed in the rear region (see FIG. 2). Thus, such parts having a relatively large width in the transverse direction are respectively arranged in the front region and the rear region, so that the thin part 107 is formed in the intermediate region. The thin part 107 is appropriately dimensioned as a handle part to fit well to a hand of a user. The brushless motor 115 is an example embodiment that corresponds to the "motor" and the "brushless motor" according to the present invention. The controller 180 is an example embodiment that corresponds to the "controller" according to the present invention.

On the thin part 107, as shown in FIG. 1, a slide switch 108*a* is provided on the upper wall 102A1, and a dial switch 108*b* is provided on the side wall 102A2. The slide switch 108*a*, the dial switch 108*b* and the battery mounting part 109 are electrically connected to the controller 180. The controller 180 is formed by arranging a switching element for controlling a plurality of coils of the brushless motor 115, a central processing unit (CPU) and a capacitor on a substrate.

Due to the above-described structure of the thin part 107, the user can operate the slide switch 108*a* or the dial switch 108*b* without contact of the palm with the outer housing joint 102C.

Further, referring to FIG. 2, when the slide switch 108*a* is operated, the controller 180 drives the brushless motor 115 to oscillate the blade 145. When the dial switch 108*b* is operated, the controller 180 changes the rotation speed of the brushless motor 115 so as to change the oscillating speed of the blade 145.

(Inner Housing)

As shown in FIG. 2, the inner housing 104 is integrally connected with the driving mechanism housing 106 by fastening members 105*a*. The inner housing 104 is formed of synthetic resin, and the driving mechanism housing 106 is formed of metal. The fastening members 105*a* are screws. As shown in FIG. 2, the driving mechanism housing 106 houses a driving mechanism 120 which drives the blade 145 by the output of the brushless motor 115.

Figure 6:
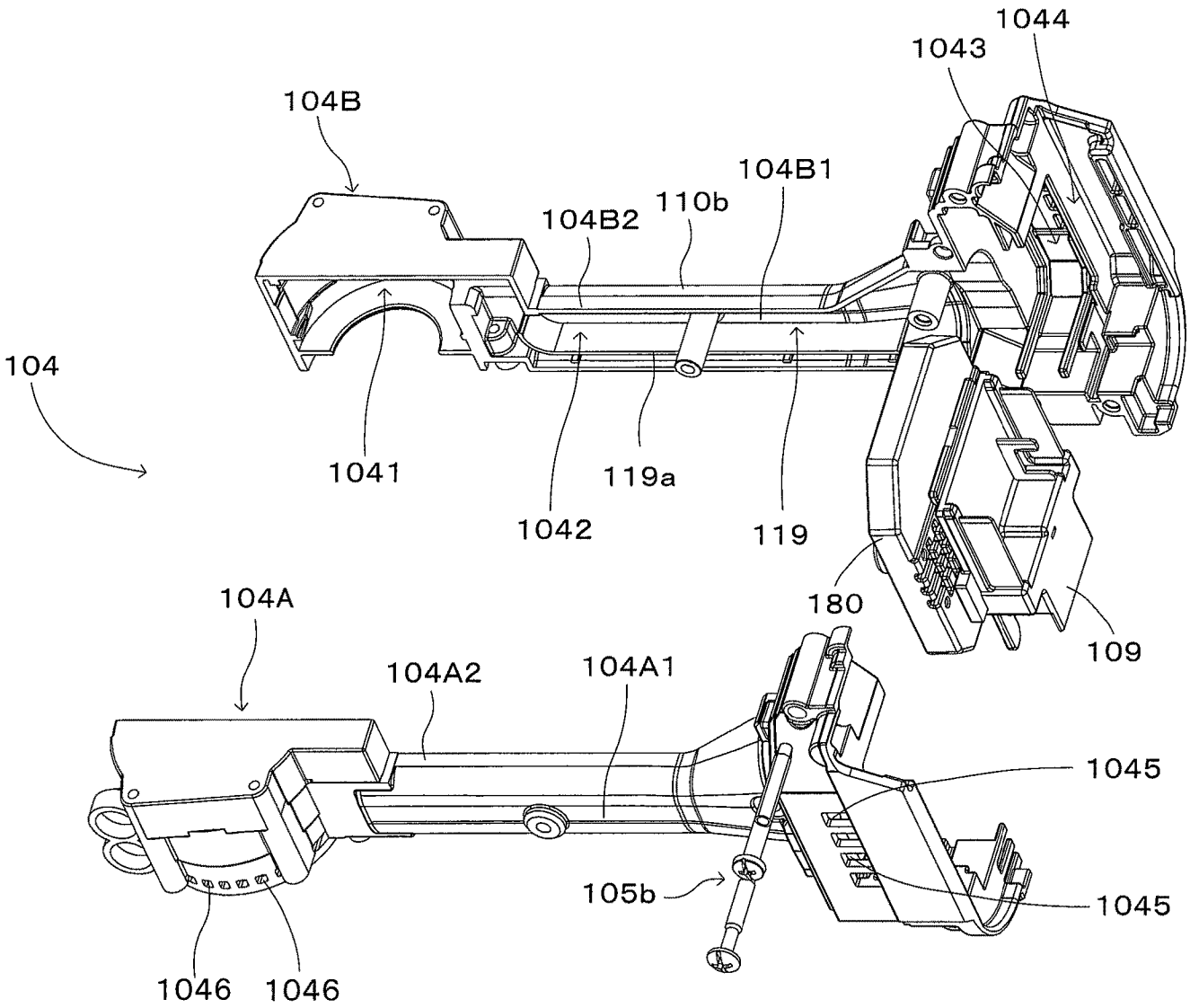
FIG. 6 is an exploded, perspective view showing parts of an inner housing.

As shown in FIGS. 4 and 6, in order to form the inner housing 104, a right inner housing element 104A and a left inner housing element 104B are assembled while being opposed to each other in the transverse direction and then integrally connected by fastening members 105*b*. For this assembling, as particularly shown in FIG. 4, the driving mechanism housing 106 having the brushless motor 115 and the spindle 124 housed therein is mounted in advance in the left inner housing element 104B, and as shown in FIG. 6, the controller 180 and the battery mounting part 109 are also mounted in advance in the left inner housing element 104B. In this state, the right inner housing element 104A is connected to the left inner housing element 104B from the transverse direction. As a result, as shown in FIGS. 7 and 8, the inner housing 104 is formed in one piece with an inner housing joint 104C extending linearly in the longitudinal direction. The fastening members 105*b* are screws. The right inner housing element 104A and the left inner housing element 104B are example embodiments that correspond to the "first inner housing element" and the "second inner housing element", respectively, according to the present invention.

As shown in FIG. 2, an output shaft 115*a* of the brushless motor 115, a rotation axis of the spindle 124 and the driving mechanism housing 106 which houses the spindle 124 are arranged such that their respective longitudinally extending components extend in the vertical direction. When these vertically extending mechanism members are mounted in the inner housing 104, as shown in FIG. 4, it is rational that the right and left inner housing elements 104A, 104B are assembled while being opposed to each other in the transverse direction. If the inner housing elements are configured to be assembled together in the vertical direction, it may be difficult to visually check the operation of mounting the mechanism members, each having a longitudinally extending component arranged to extend in the vertical direction, to one of the inner housing elements. In this embodiment, such a problem is avoided. Several mechanism members can be easily mounted in the right inner housing element 104A exposed to the outside and form a pre-assembly, and then the left inner housing element 104B is simply butted and connected to the right inner housing element 104A from the transverse direction. Thus, the inner housing 104 can be easily manufactured. Further, in such a structure in which the mechanism members are mounted in the right inner housing element 104A exposed to the outside, as shown in FIGS. 4 and 6, the controller 180 and the battery mounting part 109 can also be pre-assembled and mounted in the right inner housing element 104A. Therefore, manufacturability can be reliably improved.

As shown in FIG. 6, the right inner housing element 104A has a right wall 104A1 and a side wall 104A2 extending leftward from the right wall 104A1. The side wall 104A2 is formed on the front, upper and lower sides of the right inner housing element 104A. Specifically, the right inner housing element 104A has an open rear side. The left inner housing element 104B has a left wall 104B1 and a side wall 104B2 extending rightward from the left wall 104B1. The side wall 104B2 is formed on the front, upper and lower sides of the left inner housing element 104B. Specifically, the left inner housing element 104B has an open rear side.

With this structure, the inner housing 104 forms an internal space surrounded by the right wall 104A1, the side wall 104A2, the left wall 104B1 and the side wall 104B2. Further, as shown in FIGS. 7 and 8, the inner housing joint 104C is formed in the abutment between the side walls 104A2 and 104B2. The inner housing joint 104C is formed on the upper and lower sides of the inner housing 104 and extends in the longitudinal direction.

As shown in FIGS. 2 and 6, the internal space of the inner housing 104 has a motor housing space 1041, a connecting part housing space 1042, a controller housing space 1043 and a battery mounting part housing space 1044. As shown in FIG. 2, within the inner housing 104, the motor housing space 1041 is provided in the front region, the connecting part housing space 1042 is provided in the intermediate region, and the controller housing space 1043 and the battery mounting part housing space 1044 are provided in the rear region. The connecting part housing space 1042 is an example embodiment that corresponds to the "connecting part housing space" according to the present invention.

As shown in FIG. 6, the motor housing space 1041 is formed with a rib (motor arrangement part) for arranging the brushless motor 115. The connecting part housing space 1042 is formed with a rib 119*a* (connecting part arrangement part) for arranging a connecting part which electrically connects the brushless motor 115 and the controller 180. The connecting part (not shown) includes a feeding cable and a signal transmitting cable. The connecting part is an example embodiment that corresponds to the "connecting part" according to the present invention. The controller housing space 1043 is formed with a rib (controller arrangement part) for arranging the controller 180. The battery mounting part housing space 1044 is formed with a rib (battery mounting part arrangement part) for arranging the battery mounting part 109. The battery mounting part 109 is an example embodiment that corresponds to the "battery mounting part" according to the present invention. The battery mounting part 109 (see FIG. 2) has a power receiving terminal which is electrically connected to a power feeding terminal of the battery 190. The battery mounting part 109 is configured such that the battery 190 can be removably mounted by sliding the battery 190 in the vertical direction. Further, as shown in FIG. 2, the controller 180 is arranged to extend in the sliding direction (the vertical direction) in which the battery 190 is slid to be mounted to the battery mounting part 109. With this structure, the rear region of the outer housing 102 can be shortened in the longitudinal direction.

As shown in FIGS. 4, 6 to 8, inlets 1045 are formed in the rear region of the inner housing 104. The inlets 1045 are formed in both the right and left inner housing elements 104A and 104B. The controller 180 is arranged immediately downstream of the inlets 1045. Further, outlets 1046 are formed in the front region of the inner housing 104 in which the motor housing space 1041 is formed. Further, the connecting part housing space 1042 forms an air passage 119 which provides communication between the inlets 1045 and the outlets 1046. When a cooling fan 118 mounted on an output shaft 115*a* (see FIG. 13) of the brushless motor 115 is rotationally driven, outside air is sucked in from the inlets 1045 and discharged to the outside from the outlets 1046 via the air passage 119. By this air flow, the controller 180 and the brushless motor 115 are efficiently cooled. The internal space of the inner housing 104 can be efficiently utilized by utilizing the connecting part housing space 1042 as the air passage 119.

Further, as shown in FIG. 2, a gap is formed between the rear region of the outer housing 102 and the rear region of the inner housing 104 and forms a body inlet 1024. With this structure, air which is caused to flow by rotational driving of the cooling fan 118 is led from the body inlet 1024 to the inlets 1045.

(Elastic Members)

The outer housing 102 and the driving mechanism housing 106 are connected by elastic members, and the outer housing 102 and the inner housing 104 are also connected by elastic members. This structure prevents vibration of the driving mechanism housing 106 from being transmitted to the outer housing 102. The elastic members include a front elastic member 110*a*, an intermediate elastic member 110*b* and a rear elastic member 110*c*. The elastic member is an example embodiment that corresponds to the "elastic member" according to the present invention.

As shown in FIG. 10, four front elastic members 110*a* are arranged between projections 1031 of the intervening member 103 and the driving mechanism housing 106. The four front elastic members 110*a* form pair groups of vertically spaced members and pair groups of transversely spaced members. The front elastic members 110*a* in each pair group of transversely spaced members include a right elastic element 110*a*1 which is disposed between the right intervening element 103A and the driving mechanism housing 106, and a left elastic element 110*a*2 which is disposed between the left intervening element 103B and the driving mechanism housing 106.

As described above, the driving mechanism housing 106 is integrally connected to the inner housing 104 and the intervening member 103 is integrally connected to the outer housing 102. Therefore, the inner housing 104 and the outer housing 102 are connected via the front elastic members 110*a*. The front elastic members 110*a* are rubber elastic elements and are arranged to cover the respective projections 1031. The driving mechanism housing 106 has recesses in which the projections 1031 covered by the front elastic members 110*a* are fitted. With this structure, the front elastic members 110*a* are disposed between the driving mechanism housing 106 and the outer housing 102 so as to be capable of reducing vibration in the longitudinal, vertical and transverse directions, or more specifically, reducing vibration caused in any direction in the driving mechanism housing 106.

As shown in FIG. 3, a fastening member housing space 1022 for housing the fastening members 1023 is formed between a stator 115*b* (see FIG. 2) of the brushless motor 115 and the driving mechanism housing 106 in the housing space 1021 of the outer housing 102. The fastening members 1023 also serve as an elastic member housing space for housing the front elastic members 110*a*, so that the housing space 1021 can be effectively utilized. The fastening member housing space 1022 and the stator 115*b* are example embodiments that correspond to the "fastening member housing space" and the "stator", respectively, according to the present invention.

Figure 11:
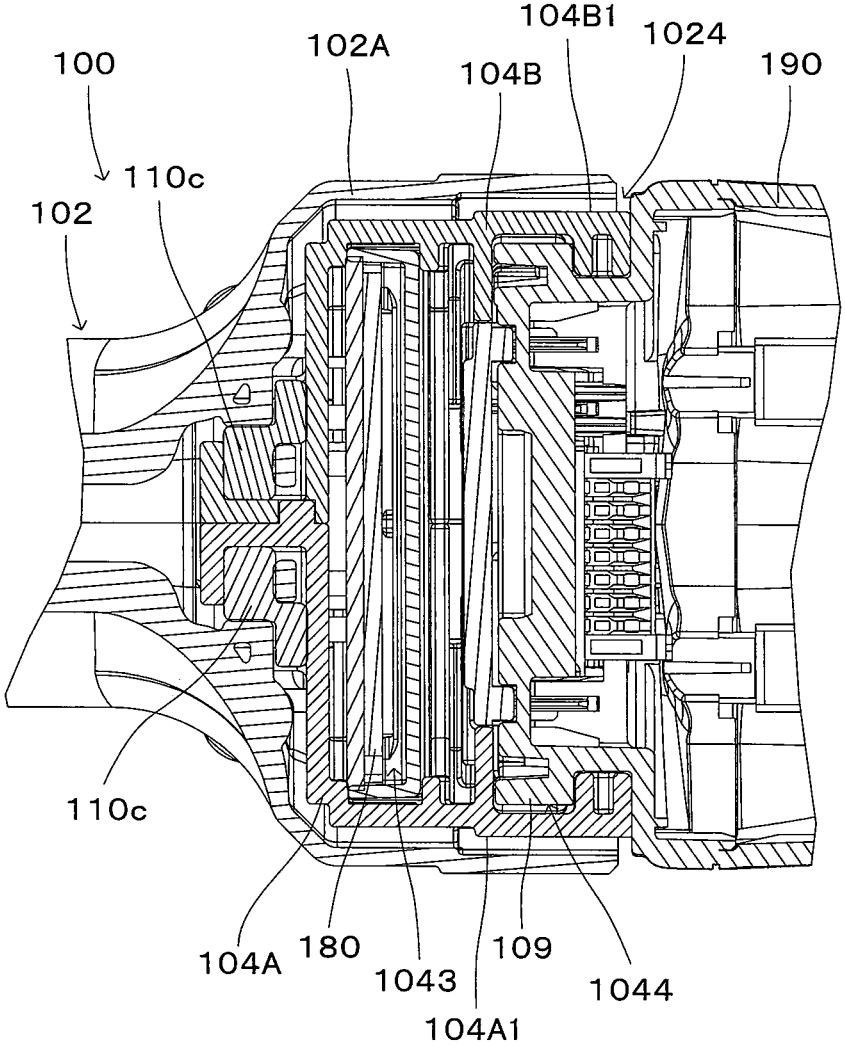
FIG. 11 is a sectional view showing the structure of an upper rear elastic member.
Figure 12:
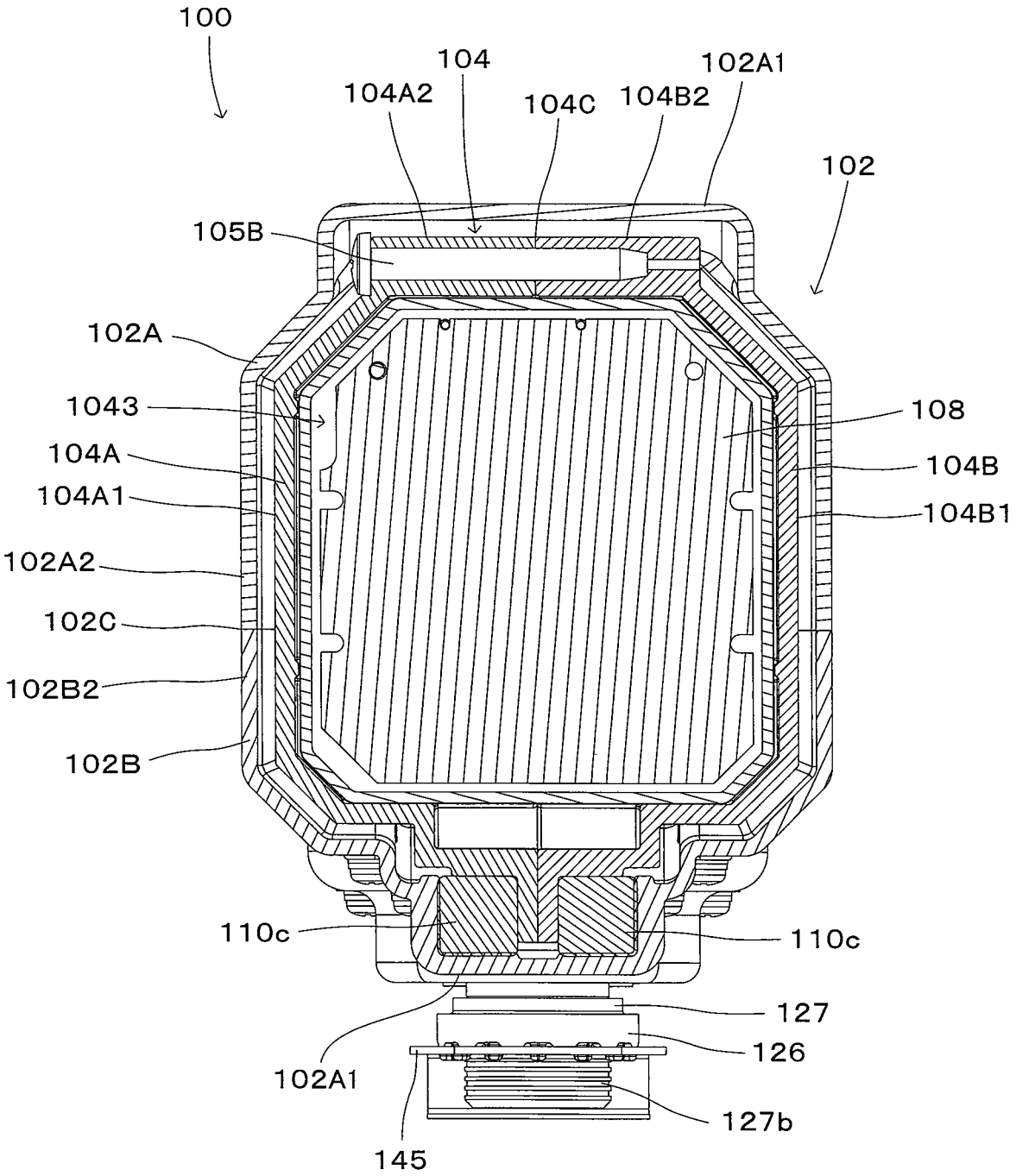
FIG. 12 is a sectional view showing the structure of a lower rear elastic member.

As shown in FIGS. 7, 8, 11 and 12, four rear elastic members 110*c* are disposed between the rear region of the inner housing 104 and the rear region of the outer housing 102. FIG. 11 is a sectional view taken along line IV-IV in FIG. 2, and FIG. 12 is a sectional view taken along line V-V in FIG. 2. The four rear elastic members 110*c* form pair groups of vertically spaced members and pair groups of transversely spaced members. The rear elastic members 110*c* are formed of rubber.

As shown in FIGS. 7 and 11, the upper rear elastic member 110*c* in each pair group of the vertically spaced members is disposed in a space between the inner housing 104 and the outer housing 102. The upper rear elastic member 110*c* is configured to extend in the longitudinal, vertical and transverse directions. Further, as shown in FIGS. 8 and 12, the lower rear elastic member 110*c* in each pair group of the vertically spaced members is disposed in a space between the inner housing 104 and the outer housing 102. The lower rear elastic member 110*c* is configured to extend in the longitudinal, vertical and transverse directions.

With this structure, the rear elastic members 110*c* are disposed between the rear region of the inner housing 104 and the rear region of the outer housing 102*c* so as to be capable of coping in the longitudinal, vertical and transverse directions of the oscillating tool 100, or more specifically, coping with vibration in all directions.

As an alternative to the above-described arrangement, the rear elastic members 110*c* may be disposed at a boundary between the rear region and the intermediate region of the inner housing 104 and a boundary between the rear region and the intermediate region of the outer housing 102. Further, the rear elastic members 110*c* may be disposed between the intermediate region of the inner housing 104 and the intermediate region of the outer housing 102*b*, or between the rear region of the inner housing 104 and the intermediate region of the outer housing 102, or between the intermediate region of the inner housing 104 and the rear region of the outer housing 102.

The intermediate region of the inner housing 104 shown in FIGS. 3, 7 and 8 is formed of synthetic resin so as to be imparted with flexibility. Thus, the intermediate region of the inner housing 104 is configured to serve as the intermediate elastic member 110*b* as well. The intermediate elastic member 110*b* extends in the longitudinal direction and can deform around its longitudinally extending axis. Therefore, transmission of vibration from the driving mechanism housing 106 to the rear region of the inner housing 104 is effectively prevented or reduced.

(Driving Mechanism)

Figure 13:
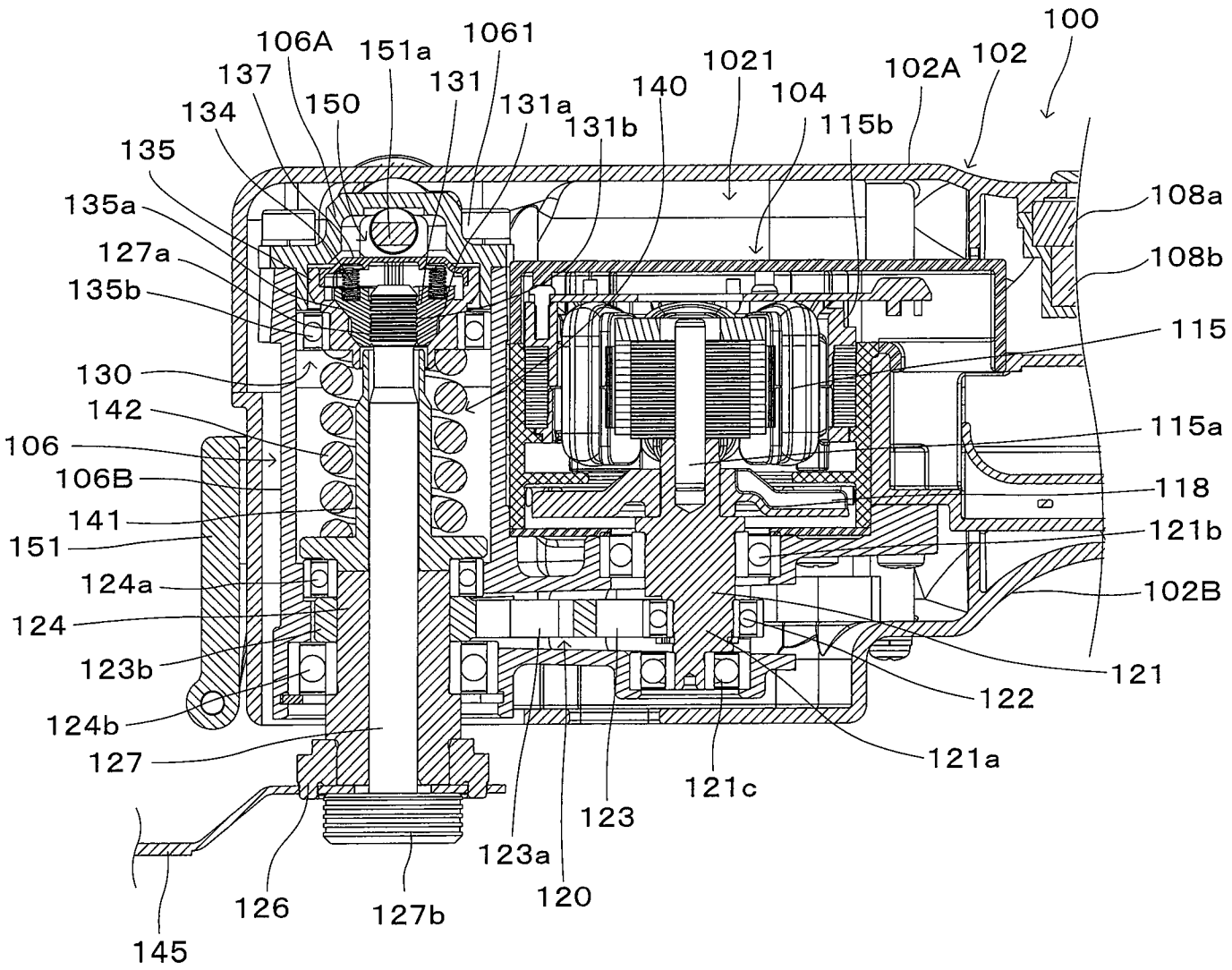
FIG. 13 is a sectional view showing the structure of a driving mechanism.
Figure 14:
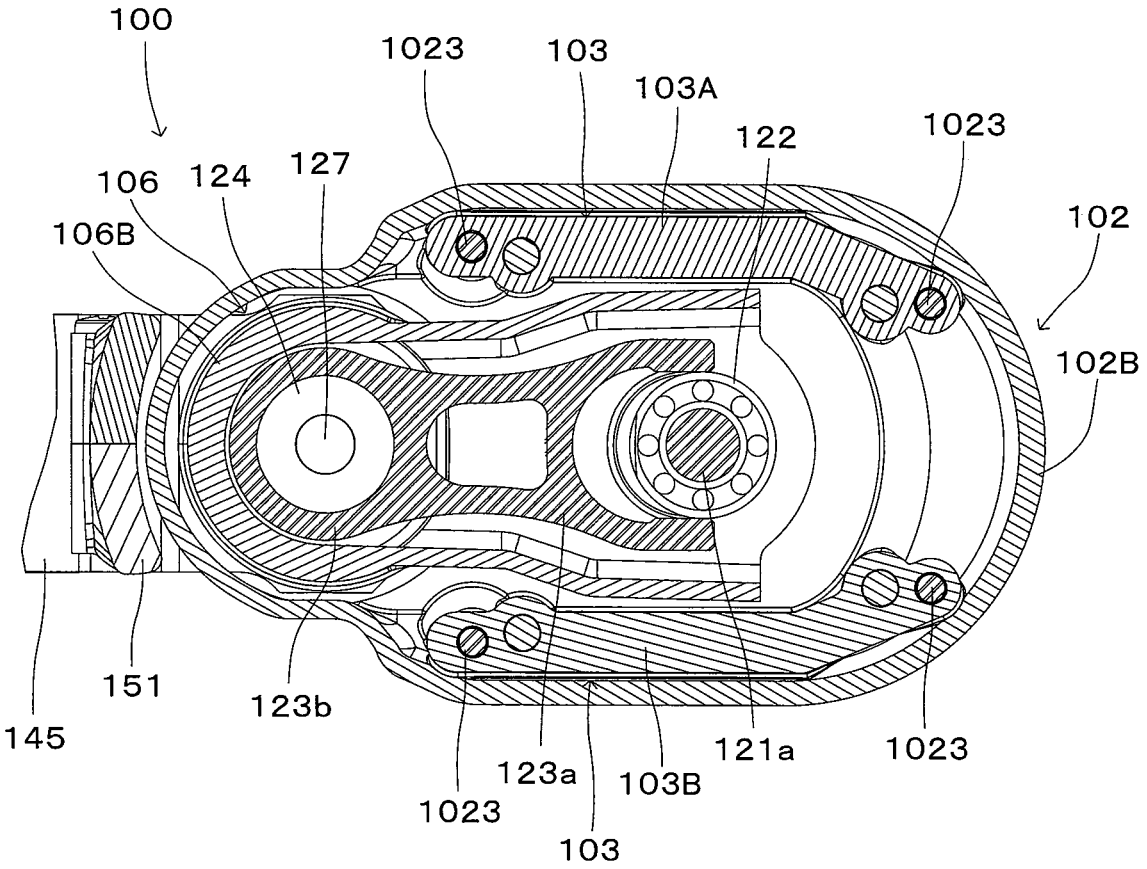
FIG. 14 is a sectional view showing the structure of a driven arm.
Figure 15:
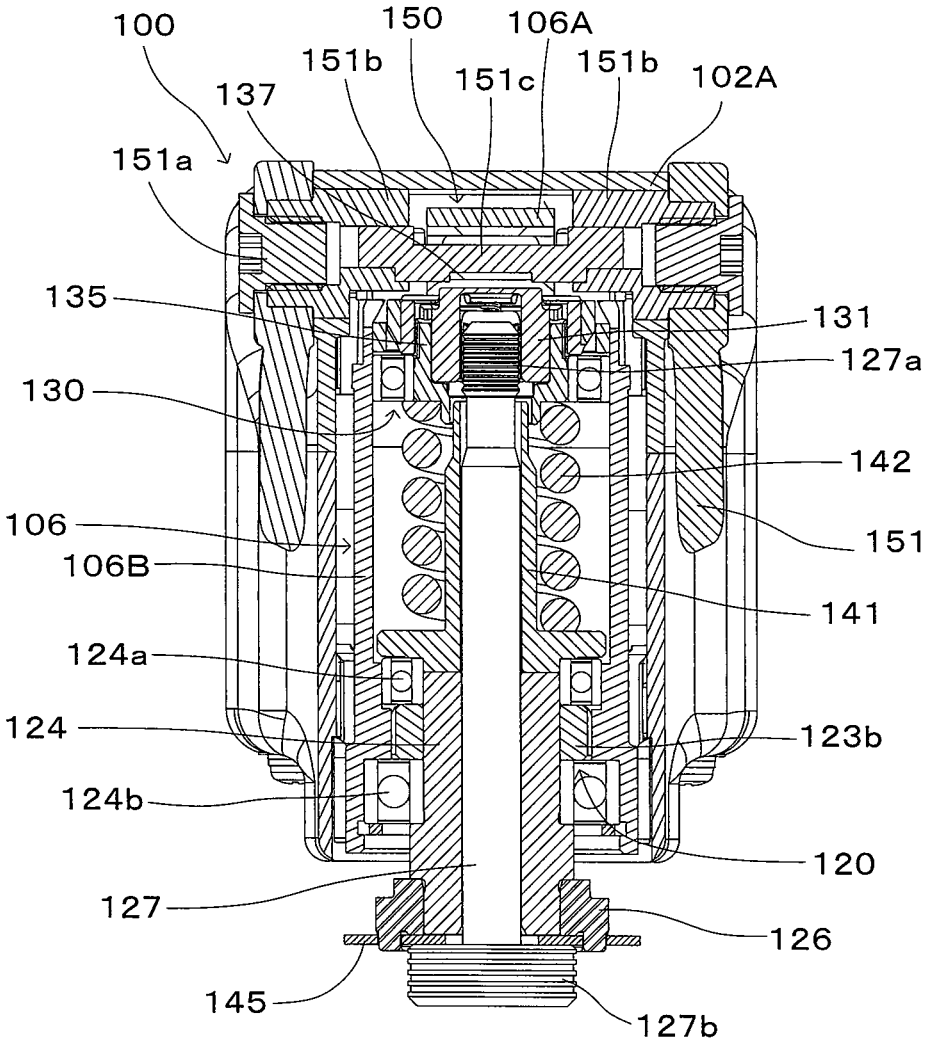
FIG. 15 is a sectional view showing the structure of a lock operation mechanism.

The structure of the driving mechanism 120 is now described with reference to FIGS. 2, 13 to 15. FIG. 13 is an enlarged sectional view showing the driving mechanism 120. FIG. 14 is a sectional view taken along line VI-VI in FIG. 2. FIG. 15 is a sectional view taken along line in FIG. 1.

As shown in FIGS. 2 and 13, the driving mechanism 12 mainly includes an eccentric shaft 121, a drive bearing 122, a driven arm 123 and the spindle 124. The spindle 124 is an example embodiment that corresponds to the "spindle" according to the present invention. The spindle 124 is cylindrically formed, and a clamp shaft 127 is removably fitted in the spindle 124. The oscillating tool 100 has a lock mechanism 130 for locking and unlocking the clamp shaft 127 with respect to the oscillating tool 100, and a lock operation mechanism 150 with which the lock mechanism 130 is manually operated by a user.

As shown in FIG. 13, the driving mechanism housing 106 has a first driving mechanism housing 106A and a second driving mechanism housing 106B, and the driving mechanism 120, the lock mechanism 130 and the lock operation mechanism 150 are disposed between the first driving mechanism housing 106A and the second driving mechanism housing 106B. The first driving mechanism housing 106A and the second driving mechanism housing 106B are integrally connected by fastening members 1061. The fastening members 1061 are screws.

As shown in FIG. 13, the direction of a rotation axis of the spindle 124 is parallel to the output shaft 115*a* of the brushless motor 115. The eccentric shaft 121 is mounted onto an end of the output shaft 115*a* of the brushless motor 115 and rotatably supported by an upper bearing 121*b* and a lower bearing 121*c*. The bearings 121*b*, 121*c* are held by the driving mechanism housing 106.

As shown in FIGS. 13 and 14, the driven arm 123 has an arm part 123*a* and a fixed part 123*b*. The arm part 123*a* is configured to be held in contact with the outer periphery of the drive bearing 122 mounted on an eccentric part 121*a* of the eccentric shaft 121. The fixed part 123*b* is configured to surround a prescribed region of the spindle 124 and fixed to the spindle 124. The driven arm 123 and the spindle 124 are arranged below the brushless motor 115. With this structure, the required dimensions of the spindle 124 can be reduced so that the spindle 124 can be shortened in the vertical direction. Further, with this structure, the blade 145 can be arranged closer to the driven arm 123 in the vertical direction. Therefore, a couple of force which is generated according to the distance between the driven arm 123 and the blade 145 is reduced. Thus, vibration which is caused by machining the workpiece with the blade 145 is reduced.

As shown in FIG. 13, the spindle 124 has a flange-like tool holding part 126 for holding the blade 145 in cooperation with the clamp shaft 127. The spindle 124 is rotatably supported by an upper bearing 124*a* and a lower bearing 124*b*.

The clamp shaft 127 is a generally columnar member configured to be inserted through the spindle 124 as shown in FIG. 13. The clamp shaft 127 has an upper end part having an engagement groove part 127*a* and a lower end part having a flange-like clamp head 127*b*. When the clamp shaft 127 is inserted through the spindle 124 and the engagement groove part 127*a* is held by the lock mechanism 130, the blade 145 is held between the clamp head 127*b* and the tool holding part 126.

When the brushless motor 115 is driven and the output shaft 115*a* is rotated, the eccentric part 121*a* of the eccentric shaft 121 and the drive bearing 122 rotate around the motor rotation axis. Thus, the driven arm 123 is driven to swing on the rotation axis of the spindle 124. As a result, the blade 145 held between the spindle 124 and the clamp shaft 127 is driven to swing to perform a prescribed operation (such as a cutting operation).

(Lock Mechanism)

The lock mechanism 130 shown in FIG. 13 serves to hold the clamp shaft 127

As shown in FIG. 13, the lock mechanism 130 mainly includes a clamp member 131, a collar member 135, a first coil spring 134, a lid member 137 and a bearing 135*b*. These components of the lock mechanism 130 form a lock mechanism assembly. Further, the lock mechanism 130 has a biasing mechanism 140 which biases the clamp shaft 127 upward. The biasing mechanism 140 mainly includes a support member 141 and a second coil spring 142.

As shown in FIG. 13, the support member 141 has a generally cylindrical hollow shape through which the clamp shaft 127 is inserted. The support member 141 is rotatably supported by the bearing 124*a*. The bearing 124*a* is configured to support both the spindle 124 and the support member 141. With this structure, the number of bearings can be reduced, and the oscillating tool 100 can be shortened in the vertical direction. The support member 141 is inserted through the second coil spring 142. The support member 141 has a flange-like lower part configured to be held in contact with a lower end of the second coil spring 142. Further, the support member 141 has an upper end configured to support the clamp member 131 when the clamp member 131 is placed in a position (disengaging position) for replacement of the blade 145.

As shown in FIG. 13, the lock mechanism 130 is disposed between the upper end of the support member 141 and the first driving mechanism housing 106A in the direction of the rotation axis of the spindle 124. The lock mechanism 130 and the spindle 124 are configured independently and arranged apart from each other, so that the lock mechanism 130 can be designed without depending on the design of the spindle 124.

As shown in FIG. 13, the clamp member 131 consists of a pair of members which hold the engagement groove part 127*a* of the clamp shaft 127 in a radial direction of the clamp shaft 127. Each clamp member 131 is configured to be movable in a direction crossing the vertical direction. Further, a plurality of ridge parts are formed on an inner surface region of the clamp member 131 facing the clamp shaft 127 and can engage with the engagement groove part 127*a* of the clamp shaft 127. Further, as shown in FIG. 13, the clamp member 131 has two clamp member inclined parts 131*a* inclined with respect to the vertical direction.

As shown in FIG. 13, the first coil spring 134 is disposed between each of the clamp members 131 and the lid member 137. The first coil spring 134 biases the clamp member 131 downward so as to stabilize the attitude of the clamp member 131.

As shown in FIG. 13, the collar member 135 serves to control clamping of the clamp shaft 127 by the clamp members 131. The collar member 135 has a hole in which the clamp members 131 are disposed and through which the clamp shaft 127 is inserted. The bearing 135*b* for rotatably supporting the collar member 135 is disposed in an outside region of the collar member 135. The bearing 135*b* is configured to be slidable with respect to the second driving mechanism housing 106B.

With this structure, the lock mechanism assembly is allowed to move in the direction of the rotation axis of the spindle 124. The collar member 135 has two collar member inclined parts 135*a* inclined with respect to the rotation axis direction of the spindle 124. The collar member inclined parts 135*a* and the clamp member inclined parts 131*a* are configured to slide in contact with each other. Therefore, the same number of the clamp member inclined parts 131*a* as the collar member inclined parts 135*a* are provided.

As shown in FIG. 13, the collar member 135 is biased by the second coil spring 142 and the clamp member 131 is biased by the first coil spring 134, so that the collar member inclined parts 135*a* come in contact with the clamp member inclined parts 131*a*. Thus, the clamp member 131 is moved inward in the radial direction of the clamp shaft 127. As a result, the two clamp members 131 hold the clamp shaft 127 while the ridge parts of the clamp members 131 are engaged with the engagement groove part 127*a* of the clamp shaft 127. The clamp shaft 127 is held between the clamp members 131 and biased upward by the second coil spring 142. In this manner, the blade 145 is held between the clamp head 127*b* of the clamp shaft 127 and the tool holding part 126 of the spindle 124.

(Lock Operation Mechanism)

The lock operation mechanism 150 shown in FIGS. 13 and 15 is configured to operate the lock mechanism 130. More specifically, the lock operation mechanism 150 is configured to move the collar member 135 in the vertical direction. By the movement of the collar member 135 in the vertical direction, the clamp member 131 is switched to be engaged with and disengaged from the clamp shaft 127.

As shown in FIGS. 13 and 15, the lock operation mechanism 150 mainly includes a handle part 151 which is operated by a user and a pivot shaft 151*a* which is interlocked with the handle part 151. As shown in FIG. 15, the pivot shaft 151*a* is arranged to extend through the driving mechanism housing 106 between the lid member 137 and the first driving mechanism housing 106A. A pair of cams 151*b* are provided on both ends of the pivot shaft 151*a* and configured to come in contact with the collar member 135. An eccentric shaft 151*c* is provided between the cams 151*b*.

FIGS. 13 and 15 show the state in which the blade 145 is attached to the oscillating tool 100. The cams 151*b* are configured not to come in contact with the collar member 135 in this state. In this state, the collar member 135 is biased upward by the second coil spring 142, and the collar member inclined parts 135*a* come in contact with the clamp member inclined parts 131*a*. As a result, the two clamp members 131 are moved toward the clamp shaft 127 and hold the clamp shaft 127. Further, the eccentric shaft 151*c* is placed apart from the first driving mechanism housing 106A. The upper end of the support member 141 is held in non-contact with the clamp members 131.

As described above, in this state, the position of the clamp shaft 127 defines a holding position for holding the blade 145, the position of the clamp member 131 defines an engaging position for engaging with the clamp shaft 127, and the position of the collar member 135 defines a maintaining position for maintaining the clamp member 131 in the engaging position.

In order to remove the blade 145 from the oscillating tool 100, the user turns the handle part 151, so that the pivot shaft 151*a* is rotated. In this state, the cams 151*b* come in contact with the collar member 135 and move the collar member 135 downward against the biasing force of the second coil spring 142. As a result, the upper end of the support member 141 comes into contact with the clamp members 131 and the clamp members 131 are moved upward with respect to the collar member 135.

When the clamp members 131 are moved upward with respect to the collar member 135, the clamp member inclined parts 131*a* are disengaged from the collar member inclined parts 135*a*, so that the clamp members 131 are allowed to move in a direction away from the clamp shaft 127. Specifically, the force of clamping the clamp shaft 127 with the clamp members 131 is reduced. In this state, the clamp shaft 127 can be pulled out downward and removed from the spindle 124. By thus releasing the clamp shaft 127, the blade 145 is also released, so that the tool accessory or blade 145 can be replaced.

In this state, the position of the collar member 135 defines an allowing position for allowing the clamp member 131 to move to a disengaging position, the position of the clamp member 131 defines the disengaging position for disengaging from the clamp shaft 127, and the position of the clamp shaft 127 defines a releasing position for releasing the blade 145.

Further, the eccentric shaft 151*c* is placed in contact with the first driving mechanism housing 106A.

(Operation of the Oscillating Tool)

Operation of the oscillating tool 100 for machining is now described with reference to FIGS. 1, 2 and 13. When a user holds the thin part 107 and turns on the slide switch 108, the controller 180 rotationally drives the brushless motor 115. Thus, the drive bearing 122 is rotated together with the eccentric shaft 121. As a result, the drive bearing 122 drives the driven arm 123, so that the blade 145 swings on the rotation axis of the spindle 124 together with the spindle 124. In this state, machining operation can be performed when the blade 145 is placed in contact with a workpiece by the user. During this machining operation, due to the structure in which the outer housing joint 102C is not formed in the upper wall 102A1 (including an upper part of the thin part 107), the user can perform the operation without feeling discomfort on the palm, so that workability can be improved.

In machining, due to the structure in which the rear region of the inner housing 104 has the controller 180 disposed therein and the battery 190 mounted thereto, the moments of inertia of the driving mechanism housing 106 and the inner housing 104 are increased, so that vibration of the driving mechanism housing 106 is reduced.

Further, when the brushless motor 115 is rotationally driven, the cooling fan 118 is rotationally driven. Then, air is taken in from the body inlet 101*d*, led into the inner housing 104 through the inlets 1045 and discharged from the outlets 1046 via the air passage 119. By this air flow, the controller 180 arranged immediately downstream of the inlets 1045 and the brushless motor 115 are cooled.

As described above, in the oscillating tool 100 according to this embodiment of the invention, an ergonomically excellent structure is provided while maintaining high manufacturing efficiency.

In the above-described embodiment, the oscillating tool 100 is described as a representative example of the work tool, but the work tool according the present invention is not limited to an oscillating tool. For example, the present invention may also be applied to a work tool such as a grinder and a circular saw in which the tool accessory rotates. Further, any number of the front elastic members 110*a*, the intermediate elastic members 110*b* and the rear elastic members 110*c* may be provided.

In the above-described embodiment, the brushless motor 115 is powered by the battery 190, but the oscillating tool 100 may be configured to use an external power source in place of the battery 190. Specifically, a power cable which can be connected to the external power source and electrically connected to the controller 180 may be connected to the rear region of the outer housing 102. When a direct current motor is used as the brushless motor 115, the controller 180 may be configured to have a function as a converter for converting an alternate current supplied from the external power source into a direct current. An alternate current motor may be used as the brushless motor 115.

(Correspondences Between the Features of the Embodiment and the Features of the Invention)

Correspondences between the features of the embodiment and the features of the invention are as follows. The above-described embodiment is a representative example for embodying the present invention, and the present invention is not limited to the structures that have been described as the representative embodiment.

The oscillating tool 100 is an example embodiment that corresponds to the "work tool" according to the present invention. The blade 145 is an example embodiment that corresponds to the "tool accessory" according to the present invention. The outer housing 102 and the inner housing 104 are example embodiments that correspond to the "outer housing" and the "inner housing", respectively, according to the present invention. The upper outer housing element 102A and the lower outer housing element 102B are example embodiments that correspond to the "first outer housing element" and the "second outer housing element", respectively, according to the present invention. The intervening member 103 is an example embodiment that corresponds to the "intervening member" according to the present invention. The brushless motor 115 is an example embodiment that corresponds to the "motor" and the "brushless motor" according to the present invention. The controller 180 is an example embodiment that corresponds to the "controller" according to the present invention. The right inner housing element 104A and the left inner housing element 104B are example embodiments that correspond to the "first inner housing element" and the "second inner housing element", respectively, according to the present invention. The connecting part housing space 1042 is an example embodiment that corresponds to the "connecting part housing space" according to the present invention. The battery mounting part 109 is an example embodiment that corresponds to the "battery mounting part" according to the present invention. The spindle 124 is an example embodiment that corresponds to the "spindle" according to the present invention. The fastening member housing space 1022 and the stator 115*b* are example embodiments that correspond to the "fastening member housing space" and the "stator", respectively, according to the present invention.

DESCRIPTION OF THE NUMERALS

100 oscillating tool (work tool)
102 outer housing
1021 housing space
1022 fastening member housing space
1023 fastening member
1024 body inlet
102A upper outer housing element (first outer housing element)
102A1 upper wall
102A2 side wall
102B lower outer housing element (second outer housing element)
102B1 lower wall
102B2 side wall
102C outer housing joint
103 intervening member
1031 projection
103A right intervening element
103B left intervening element
104 inner housing
1041 motor housing space
1042 connecting part housing space
1042*a* rib
1043 controller housing space
1044 battery mounting part housing space
1045 inlet
1046 outlet
104A right inner housing element (first inner housing element)
104A1 right wall
104A2 side wall
104B left inner housing element (second inner housing element)
104B1 left wall
104B2 side wall
104C inner housing joint
105*a* fastening member
105*b* fastening member
106 driving mechanism housing
106A first driving mechanism housing
106B second driving mechanism housing
1061 fastening member
107 thin part
108*a* slide switch
108*b* dial switch
109 battery mounting part

110*a* front elastic member
110*a*1 right elastic element (first elastic element)
110*a*2 left elastic element (second elastic element)
110*b* intermediate elastic member
110*c* rear elastic member
115 brushless motor
115*a* output shaft
115*b* stator
118 cooling fan
119 air passage
119*a* rib
120 driving mechanism
121 eccentric shaft
121*a* eccentric part
121*b* bearing
121*c* bearing
122 drive bearing
123 driven arm
123*a* arm part
123*b* fixed part
124 spindle
124*a* bearing
124*b* bearing
126 tool holding part
127 clamp shaft
127*a* engagement groove part
127*b* clamp head
130 lock mechanism
131 clamp member
131*a* clamp member inclined part
131*b* projection
134 first coil spring
135 collar member
135*a* collar member inclined part
135*b* bearing
137 lid member
140 biasing mechanism
141 support member
141*a* coil spring support part
141*b* clamp member support part
142 second coil spring
145 blade (tool accessory)
150 lock operation mechanism
151 handle part
151*a* pivot shaft
151*b* cam
151*c* eccentric shaft
180 controller
190 battery

The invention claimed is:

1. A work tool, which performs a prescribed operation on a workpiece by driving a tool accessory, comprising:

a motor, a spindle having a rotation axis and configured to be rotated on the rotation axis within a prescribed angular range via the motor to drive the tool accessory, an inner housing configured to house at least the motor, an outer housing having an elongate form and configured to house the inner housing, and an elastic member disposed between the inner housing and the outer housing, wherein:

the inner housing has a first inner housing element and a second inner housing element which are assembled into the inner housing, the outer housing has a first outer housing element and a second outer housing element which are assembled into the outer housing, and wherein a longitudinal direction of the outer housing is defined as a longitudinal direction, an extending direction of the rotation axis of the spindle is defined as a vertical direction, and a direction perpendicular to the longitudinal direction and the vertical direction is defined as a transverse direction, the first inner housing element and the second inner housing element are assembled while being opposed to each other in the transverse direction, and the first outer housing element and the second outer housing element are assembled while being opposed to each other in the vertical direction.

2. The work tool as defined in claim 1, comprising a brushless motor that forms the motor, and a controller that controls driving of the brushless motor, wherein an output shaft of the brushless motor is arranged in parallel to the rotation axis of the spindle.

3. The work tool as defined in claim 2, comprising a fastening member extending in a direction of the rotation axis and configured to fasten the first and second outer housing elements to each other, wherein the outer housing has a housing space for the fastening member between a stator of the brushless motor and the spindle.

4. The work tool as defined in claim 3, wherein the fastening member housing space also serves as an elastic member housing space for housing the elastic member.

5. The work tool as defined in claim 1, further comprising an electrical member, wherein the inner housing has an elongate form extending in the longitudinal direction of the outer housing and houses at least the motor in one end region in the longitudinal direction and has the electrical member in the other end region.

6. The work tool as defined in claim 1, further comprising a battery mounting part for mounting a battery for driving the motor, wherein the inner housing has an elongate form extending in the longitudinal direction of the outer housing and houses at least the motor in one end region in the longitudinal direction and has the battery mounting part in the other end region.

7. The work tool as defined in claim 1, wherein the elastic member is held in the transverse direction between the inner housing and the outer housing via an intervening member.

* * * * *